United States Patent [19]

Peronek

[11] 4,335,761

[45] Jun. 22, 1982

[54] RECIPROCAL BOTTLE FILLING DEVICE

[75] Inventor: Michael H. Peronek, Chagrin Falls, Ohio

[73] Assignee: FCI, Inc., Cleveland, Ohio

[21] Appl. No.: 170,712

[22] Filed: Jul. 21, 1980

[51] Int. Cl.[3] ..... B65B 3/04; B67C 3/26

[52] U.S. Cl. ..... 141/371

[58] Field of Search ..... 141/39, 40, 181, 369–374, 141/392

[56] References Cited

U.S. PATENT DOCUMENTS 2,861,605 11/1958 Oliver ..... 141/374 X 3,742,989 7/1973 Campbell et al. ..... 141/371

FOREIGN PATENT DOCUMENTS 361497 5/1962 Switzerland ..... 141/371

*Primary Examiner*—Frederick R. Schmidt

*Attorney, Agent, or Firm*—Meyer, Tilberry & Body

[57] ABSTRACT

A reciprocating bottle filling assembly is provided with an improved centering guide comprised of two parts. The upper part is rigid and provides support for a pliable non-metallic lower part having a continuous downwardly and outwardly flaring lower surface. The lower surface flexes and deforms easily whereby a bottle can be centered without breakage and a seal provided at the bottle top. A gap is provided between the upper and lower parts around their outer portions improving flexibility of the outer portion of the lower part.

5 Claims, 4 Drawing Figures

RECIPROCAL BOTTLE FILLING DEVICE

BACKGROUND OF THE INVENTION

This invention relates to the art of fluent material handling and more particularly to a device for filling bottles in a high speed bottling line.

Beverage distribution and manufacturing has become increasingly automated and concentrated. Beer, soft drinks, spring water and other beverages are currently produced in large quantities and placed into glass bottles which have been cleaned and inspected on high speed automated bottling lines. After the bottles have been automatically filled with the appropriate amount of beverage, they are automatically capped, packaged and prepared for shipment.

The present application describes a new device for use in the filling operations on these lines.

Many fluids can be filled into a bottle by simply bringing the top of an empty bottle into sealed contact with a stationary filling port and introducing the fluid into the bottle through the port. No moving parts are required at the port and precise centering of the bottle with respect to the port is not required. Easily removable frustoconically faced sealing rings have been in long use to provide seals at these ports. These sealing rings are of a simple design as their function is straightforward and easily accomplished.

Certain beverages, notably beer, are most advantageously filled into a bottle by introducing an elongated filling tube into the bottle to an appreciable depth and introducing the beverage into the bottle through this tube. This operation requires that the bottles be precisely centered underneath the filling assembly before the lowering of the tube and a seal provided between the bottle top and the filling assembly. The centering of a bottle with respect to the filling assembly and sealing the bottle filling assembly junction is a much more sophisticated and complex operation than the sealing operation needed at a sealing port.

In the past, filling assemblies or heads have been comprised of a metallic filling tube pressed into an upper adapter which provides support and connections to the tube. Slidably supported on the filling tube is a metallic sealing and centering guide or bell. The centering guide normally rests on the lower end of the filling tube prior to engagement with a bottle to be filled. The lower surface of the centering guide is flared outwardly and downwardly into a bell-like shape and interacts with the nose shaped lower end of the filling tube to provide the centering action necessary for proper engagement of the filling assembly with a bottle. When a bottle enters the filling area, its top comes under a portion of the centering guide. As the centering guide is lowered, its bell-like lower surface and the surface of the lower end of the filling tube moves the bottle top to be coaxial with the vertical axis of the filling tube. The filling tube is then inserted into the bottle until the centering guide is in pressure contact with the upper adapter thereby pressing the centering guide into pressure engagement with the bottle top. A rubber like annular sealing ring is provided in the upper interior portion of the centering guide lower surface to provide a seal at the bottle top. The bottle is in sealed, aligned engagement with the filling head and filling can proceed. At the end of the filling operation, the filling assembly or head is lifted upwardly, disengaging the entire assembly from the bottle which then proceeds down the bottling line.

Significant difficulties have been experienced in bottling lines using the above technique at the point of filling. The metallic centering guide can crack, break or chip bottles in its initial encounter or during the centering operation. This can result in the head being contaminated with broken glass which may be introduced into the next bottle on the line. Glass is also embedded into the seal in the upper portion of the centering guide lower surface which can be introduced into the next bottle or can interfere with proper sealing action. Consequently, extensive and detailed inspection for glass particles must be made by the bottler.

Also, the centering guide and seal are fabricated from two diverse materials having a seam or mating line between them at a position very close to the desired position for bottle tops. The seam or mating line is an ideal area for the growth of mold, bacteria and other organic contaminants which can then be transferred to the bottle top, adversely affecting quality.

Additionally, the sealing ring in the upper interior of the centering guide is difficult to remove from the centering guide. The entire metallic centering guide must normally be removed to remove this sealing ring. Because the centering guide rests on the lower extremity of the filling tube during normal operations, the bore through the center of the centering guide must be smaller in diameter than the outside diameter of the bottom extremity of the filling tube. Complete disassembly of the filling head is therefore required for removal or maintenance of the sealing ring requiring substantial downtime for the filling machine. Consequently, the sealing ring often remains in the centering guide even though it has deteriorated.

SUMMARY OF THE INVENTION

The present invention overcomes these problems and provides an improved filling assembly or head which is reliable in use, easily renewable, easily cleaned and less likely to break the bottle being filled than anything heretofore known.

In accordance with the present invention, a bottling machine movable filling assembly or head is provided having a hollow filling tube with a curved nose and a centering guide having a rigid upper part and a pliable lower part. The pliable lower part has a downwardly and outwardly flaring lower surface which interacts with the shaped nose to provide centering of bottles to be filled without breakage and superior sealing.

Further in accordance with the invention, a centering guide is provided in two parts, an upper part and a lower part, the downwardly facing centering surface being disposed entirely on the lower part and the lower part being substantially more resilient and pliable than the upper part.

Still further in accordance with the invention, a centering guide comprised of an upper part and a lower part is provided, the lower part of which is fabricated entirely from a pliable resilient non-metallic material having a central aperture with a diameter at least as great as the largest diameter of the downward end of the filling tube and the lower part is made easily separable from the upper part.

Yet further in accordance with the present invention, a bottling machine movable filling assembly or head is provided having a hollow filling tube with a curved nose and a centering guide with a continuous resilient pliable downwardly facing surface comprised of a first frustoconical surface flaring outwardly and downwardly from a central aperture and a second frustoconical surface flaring outwardly and downwardly from a circle having a diameter at least as great as the largest diameter of the first frustoconical surface, the second frustoconical surface having a slope closer to vertical than the first frustoconical surface.

The primary object of the present invention is the provision of an apparatus for filling glass containers with beverages which will center the glass containers with respect to the filling tube with minimum breakage and contamination.

Yet another object of the present invention is the provision of a centering guide on a bottle filling apparatus having a continuous downwardly facing surface which will be less easily contaminated and provide less hospitable surfaces for the growth of bacteria, mold or other organic contaminants.

Still another object of the present invention is the provision of a bottle filling assembly or head having a centering guide lower surface which may be easily removed for cleaning or replacement without substantial downtime.

These and other objects and advantages of the present invention will become apparent from the following description taken together with the accompanying drawings.

THE PREFERRED EMBODIMENT

Figure 1:
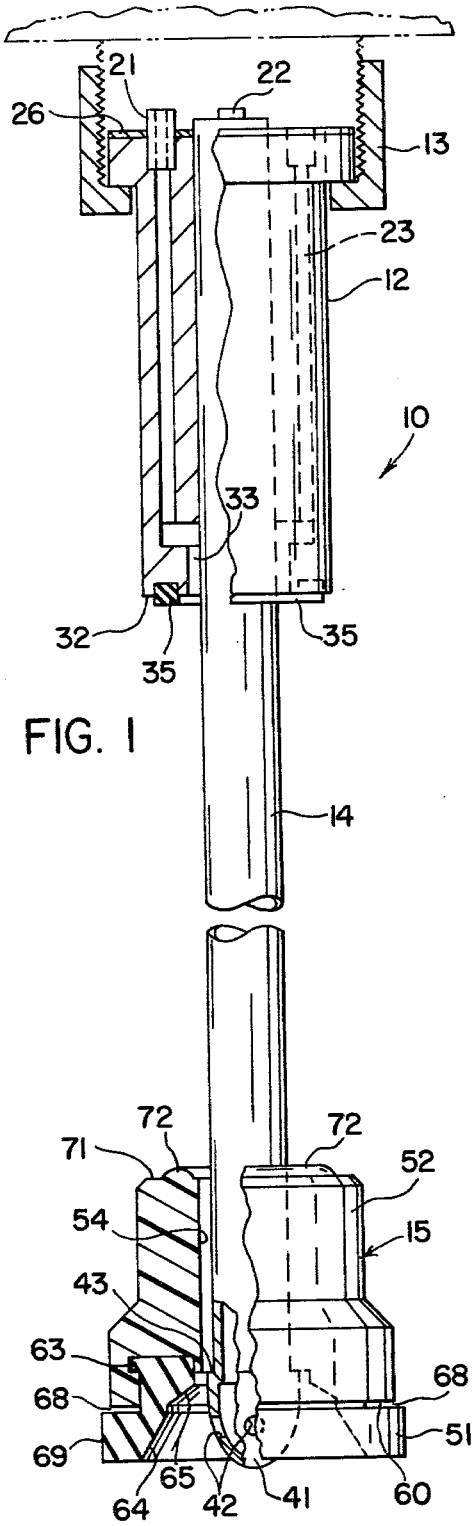
FIG. 1 is a side elevation, partially cut away, of a filling assembly or head employing the present invention in the disengaged position.

Referring now to FIG. 1, a filling assembly or head 10 embodying the present invention is illustrated. The assembly is comprised of four sub-assemblies; an upper adapter 12; a retaining nut 13; a filling tube 14 and a centering guide 15.

In operation, a battery of filling heads 10 are fixed to a filling machine in a bottling line. The bottles are brought into approximate position under the filling head by a conveyor system and the filling machine brings the filling head into contact with an empty bottle for a sufficiently long period of time to accomplish filling. Mechanical interconnection is provided by the upper adapter 12 and the retaining nut 13 which firmly affixes the entire assembly to the filling machine and also provides interconnections for receiving liquid and venting gases during the filling operation. These filling machines are well known and available from numerous sources. Neither the filling machine itself or the interconnection of the filling machine to the filling head 10 forms a part of the invention.

Two locating pins 21, 22 are provided on the top surface of upper adapter 12 to positively index the upper adapter with the bottling machine. One of these locating pins 21 is bored to provide a gas passageway between the upper adapter and the bottling machine. A second gas passageway 23 is also provided through the upper adapter top surface. The filling tube 14 extends completely through the upper adapter and slightly above its top surface. A gasket 26 is provided with appropriate apertures for all of the locating pins, gas passages and filling tube and interposed between the top surface of the upper adapter and filling machine to provide a seal at this point.

The filling tube 14 is pressed into an appropriate central bore along the central axis of the upper adapter and is in interference fit. This bore is enlarged near the lower surface 32 of the upper adapter to provide an annular recess 33 around the filling tube 14 and a seal 35 is provided around this recess extending downwardly slightly below the lower surface 32 of the upper adapter.

Figure 2:
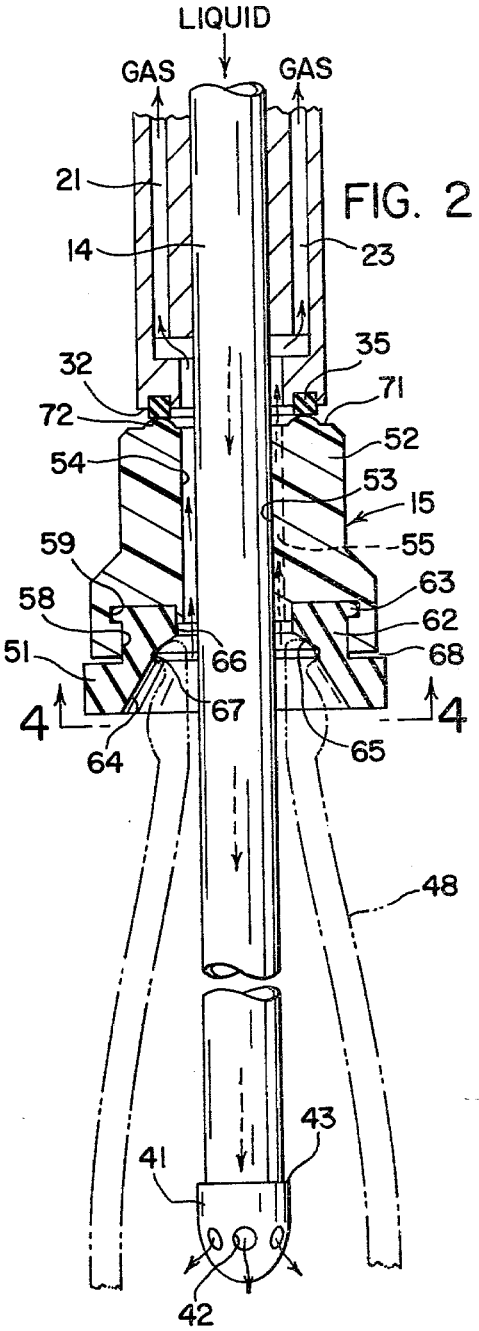
FIG. 2 is a side elevation of a filling assembly or head employing the present invention in the engaged position showing the centering guide in cross-section.

As best seen in FIG. 2, filling tube 14 extends downwardly from upper adapter 12 and has a uniform cross-section over most of its length. A dispenser pilot 41 having a rounded nose shape is disposed at the bottom of filling tube 14 which is designed to penetrate the circular opening on the top of a bottle. Dispenser pilot 41 coacts with the centering guide 15 in centering bottles in the filling operation. Dispenser holes 42 are disposed around the dispenser pilot 41. An annular shoulder 43 is provided at the upper end of the dispenser pilot 41 to support centering guide 15 in its disengaged position.

As can be seen in FIG. 2, during the filling operation, dispenser pilot 41 is well within bottle 48 whereby liquid can be introduced into bottle 48 through the dispensing holes 42 below the liquid level in the bottle for a portion of the filling operation. With certain beverages and other products to be bottled, more complete and satisfactory filling can be obtained from filling in this manner.

The interaction of the dispenser pilot 41 and centering guide 15 can be seen in FIG. 1 which shows the centering guide 15 in the disengaged position.

Figure 3:
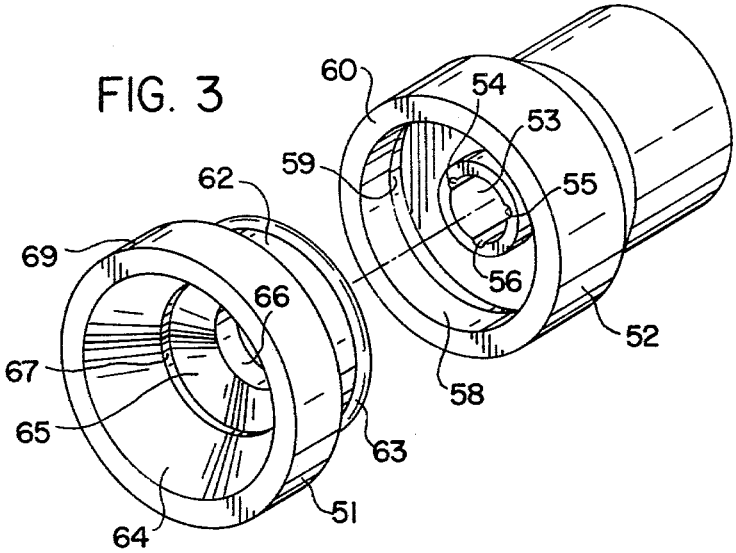
FIG. 3 is an exploded perspective view of the two parts of the centering guide of the present invention; and, FIG. 4 is a bottom plan view of the centering guide showing the filling tube in section.
Figure 4:
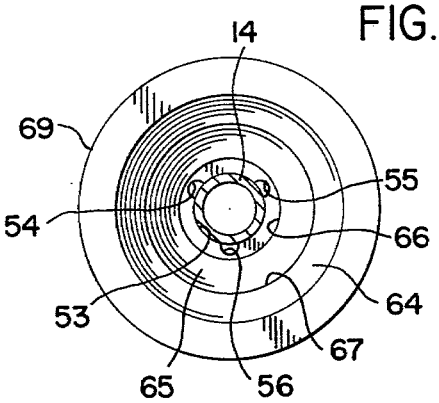

Importantly, centering guide 15 is comprised of two parts (shown in FIGS. 3 and 4), a lower bell part 51 and an upper holding part 52. Upper holding part 52 is provided with a central bore 53 having axial grooves 54, 55, 56 disposed around the bore. The upper holding part 52 is slidably supported on filling tube 14 and retained on filling tube 14 by shoulder 43. Holding part 52 is provided with a circular bottom recess 58 having a given depth and an undercut groove 59 near its top. Surrounding recess 58 is an annular bottom surface 60.

Lower bell part 51 is more pliable than upper holding part 52. Bell part 51 has an upper cylinder portion 62 which is slightly taller than recess 58 and a rib 63 around its periphery which engages grooves 59 in the holding part 52 to releasably connect lower bell part 51 to holding part 52.

The lower surface of lower bell part 51 is symmetrical about its center and is comprised of an outer frustoconical surface 64 and an inner frustoconical surface 65. Inner frustoconical surface 65 flares outwardly and downwardly from a central aperture 66 at a first given angle with respect to the vertical axis. A vertical cylindrical surface 67 extends downwardly from inner frustoconical surface 65 to the inner edge of outer frustoconical surface 64. Outer frustoconical surface 64 flares outwardly and downwardly at a second given angle with respect to vertical which is smaller than the first given angle.

As can best be seen in FIG. 1, the lower surfaces of bell part 51 and the dispenser pilot 41 comprises a centering guide surface ideally suited for engaging approximately aligned bottle tops and bringing them into better alignment with the filling head. This centering action is enhanced by the interaction of the upper holding part and the lower bell part 51. Because the upper cylinder portion 62 extends out of recess 58, a gap 68 is provided between the outer portion 69 of the lower bell part and the upper holding part lower surface 60. This gas allows lower bell part 51 to deform and tilt slightly when the top of a bottle strikes outer frustoconical surface 64. This controlled tilting and deformation coupled with the resilience of lower bell part 51 provides excellent centering without breakage.

After the bottle 48 is centered, the bottle top engages inner frustoconical surface 65 which is above gap 68. As there is no gap above inner frustoconical surface 65, it cannot tilt or deform as readily as outer frustoconical surface 64; surface 65 will be held squarely against the bottle top by upper holding part 52 and only deform sufficiently to seal the bottle top.

Upper holding part 52 is fabricated from a hard non-pliable plastic such as an acetal resin available from DuPont under the trademark Delrin.

Lower bell part 51 is fabricated from a resilient polyvinyl chloride plastic which is much more pliable than that used for upper holding part 52. Lower bell part 51 can be very pliable as it is pushed against upper holding part 52 during operation which acts as a cupped form strengthening bell part 51 against damage. Bell part 51 is preferably fabricated from a plastic having a durometer hardness between A50 and A95 and preferably between A55 and A80. Polyvinyl chloride is formulated by numerous sources with an FDA approval for use in food processing equipment.

SUMMARY OF OPERATION

In operation, an empty bottle 48 which has been prepared for filling is brought into approximate alignment with filling head 10 by a conveyor system. The filling head or assembly 10 is in the disengaged position shown in FIG. 1. The lower surface of lower bell part 51 and the dispenser pilot 41 are then brought downwardly to the top of the bottle 48. The bell part 51 and dispenser pilot 41 provide a downwardly flared guideway for the bottle top, centering the bottle as it is engaged. Because the bell part 51 is pliable and resilient, it is less likely to chip or break the bottle 48 as the bottle top slides along a portion of outer frustoconical surface 64 into contact with inner frustoconical surface 65. The filling head 10 continues to move downwardly with respect to the bottle 48 inserting the filling tube 14 into the bottle 48 and bringing the upper adapter 12 into pressured contact with the centering guide 15. The lower seal 35 on lower surface 32 of the upper adapter engages circular rib 72 on the upper surface 71 of centering guide 15. Pliable lower bell part 51 seals the junction between itself and holding part 51 and also seals around the bottle top. Thus, in the position shown in FIG. 2 a gas tight system is provided for filling the bottle 48. Liquid can enter the bottle through filling tube 14 and gas can exist along axial grooves 54, 55, 56 through holding part 52 into annular recess 32 and then into gas passages 23 and 21. Filling can take place under sealed and controlled circumstances in an automated fashion.

After the bottle or container 48 is filled to the desired level, filling head 10 is retracted, ending the sealed relationship and withdrawing filling tube 14 from the bottle which can then be passed through a capping station and be packaged.

Should any part of lower bell part 51 become contaminated or damaged, it is a simple matter to remove lower bell part 51 and push a new lower bell part 51 into its place. No tools are needed and no other portions of the machine need be disassembled to perform this maintenance.

While a preferred embodiment of the present invention has been shown and described, it is apparent that various changes and modifications may be made by those skilled in the art. It is therefore intended in all of the following claims to cover all such modifications and changes to the extent they fall within the scope of this invention.

Having thus described the invention, the following is claimed:

1. In a bottling machine movable filling assembly having a vertical axis, comprised of, of hollow filling tube extending axial downwardly, having a lower portion with an outer diameter;

an attachment means adapted to attach said filling assembly to a bottling machine; and, a centering guide slidably mounted on said filling tube, the improvement which comprises said centering guide being comprised of; an upper holding part; a non-metallic pliable lower bell part having a continuous lower surface comprised of an inner sealing portion adapted to form an airtight seal with a bottle flaring outwardly and downwardly from a central aperture and an outer portion flaring outwardly and downwardly from said inner portion; and, an annular gap between said upper holding part and said lower bell part above said outer portion extending radially outwardly allowing said outer portion to deform and said lower bell part to tilt when a bottle is encountered.

2. The improvement of claim 1 wherein said lower bell part central aperture has a circular cross-section with a diameter at least as great as the outside diameter of the lower portion of said filling tube.

3. The improvement of claim 2 wherein said upper holding part has a downwardly extending annular flange surrounding a cylindrical recess having a given diameter and a given depth, and said lower bell part has an upstanding cylindrical projection having a diameter equal or slightly less than said cylindrical recess diameter and a height slightly greater than said cylindrical recess depth.

4. The improvement of claim 1 wherein said upper holding part has a downwardly extending annular flange surrounding a cylindrical recess having a given diameter and a given depth, and said lower bell part has an upstanding cylindrical projection having a diameter equal or slightly less than said cylindrical recess diameter and a height slightly greater than said cylindrical recess depth.

5. In a bottling machine movable filling assembly having a vertical axis, comprised of a hollow filling tube extending axially downwardly adapted to be inserted into a bottle and a centering guide slidably mounted on said filling tube, said centering guide having a downwardly and outwardly flaring lower surface; the improvement comprising: said centering guide being comprised of an upper holding part and a pliable lower bell part releasably joined together; said lower bell part having a lower surface having at least a first frustoconical segment flaring downwardly and outwardly from a central aperture and forming a first angle with said vertical axis and a second frustoconical segment flaring outwardly and downwardly from said first frustoconical segment and forming a second angle with said vertical axis, said second frustoconical segment more closely aligned with vertical than said first frustoconical segment; and, a gap provided between said upper holding part and said lower bell part above and radially outward from said second frustoconical segment to allow said second frusto-conical segment to deform and said lower bell part to tilt when a bottle is encountered.

* * * * *